United States Patent [19]

Drori

[11] 4,077,371

[45] Mar. 7, 1978

[54] FUEL SAVING SYSTEM FOR AUTOMOBILES

[76] Inventor: Mordeki Drori, 89 Zahal Street, Kiron, Israel

[21] Appl. No.: 658,609

[22] Filed: Feb. 17, 1976

[30] Foreign Application Priority Data

Mar. 27, 1975 Israel ..... 46720

[51] Int. Cl.[2] ..... F02D 13/02

[52] U.S. Cl. ..... 123/106; 137/48; 73/514

[58] Field of Search ..... 123/106, 115, 8.09; 60/39.16 R, 39.28 P; 137/48; 73/514

[56] References Cited

U.S. PATENT DOCUMENTS

| | | | |
|---|---|---|---|
| 1,888,248 | 11/1932 | Steinhardt | 123/106 |
| 2,198,032 | 4/1940 | Farmer | 73/514 X |
| 2,427,239 | 9/1947 | Taylor | 73/514 X |
| 3,227,834 | 1/1966 | Keese | 73/514 |
| 3,279,447 | 10/1966 | Barnett | 123/106 X |
| 3,311,423 | 3/1967 | Horvath | 137/48 X |
| 3,733,815 | 5/1973 | Karol | 60/39.16 R |
| 3,938,611 | 2/1976 | Bertolasi | 123/106 X |

*Primary Examiner*—Clarence R. Gordon
*Attorney, Agent, or Firm*—Benjamin J. Barish

[57] ABSTRACT

A fuel control system for automobile engines comprises load-sensor means for sensing the load on the engine, and fuel-mixture-ratio control means responsive to the load-sensor means to control the fuel-mixture ratio such as to produce a richer fuel mixture with increased loads, and a leaner fuel mixture with decreased loads.

7 Claims, 2 Drawing Figures

MIXTURE RATIO CONTROL
CARBURETOR
AUTOMOBILE
ENGINE
MIXTURE QUANTITY CONTROL

FUEL SAVING SYSTEM FOR AUTOMOBILES

BACKGROUND OF THE INVENTION

The present invention relates to a system for effecting fuel savings in automobiles by controlling the fuel mixture supplied to the automobile engine to decrease the fuel-consumption rate.

In conventional automobile engines, the main carburetor usually supplies a substantially constant air-fuel mixture ratio throughout the range of operation of the automobile. If this fuel ratio is set for lean mixtures, for example in an attempt to obtain lower fuel-consumption rates, the power output may not be sufficient during rapid acceleration or steep ascents, which may cause the engine to miss or to stall. Accordingly, the mixture-ratio is usually set to produce slightly richer fuel mixtures than may be required under normal driving conditions, which causes the fuel-consumption rate to suffer.

SUMMARY OF THE INVENTION

An object of the present invention is to provide a system for controlling the fuel mixture supplied to automobile engines so as to produce lower fuel-consumption rates than in the conventional engines.

According to a broad aspect of the invention, there is provided a fuel control system for automobile engines including a carburetor for forming an air-fuel mixture and means for controlling the quantity of the mixture to be supplied to the automobile engine in accordance with the power demanded to be supplied thereby to a member driven by the engine, characterized in that the fuel control system includes load-sensor means for sensing the load applied by the driven member on the engine; and mixture-ratio-control means responsive to the load-sensor means to control the mixture ratio such as to produce a richer fuel mixture with increased loads and a leaner fuel mixture with decreased loads.

The invention may take many different forms. In a preferred embodiment of the invention described below, the load-sensor comprises: a drive shaft connected to the engine; a driven shaft connected to the driven member; and a coupling between the two shafts, said coupling including an element displaceable in accordance with the load on the driven shaft, the displacement of said element controlling the mixture-ratio-control means.

Also in this preferred embodiment, the coupling includes a coupling member having a cam surface; a spring interposed between the driven member and the driven shaft and urging the cam surface into engagement with a surface on the drive shaft, the cam surface causing the coupling member to be moved axially with respect to the drive shaft upon changes in load; and means for displacing said displaceable element in accordance with said axial movement of the coupling member.

According to another feature in the described embodiment, the coupling includes an annular ring which is axially movable in accordance with the load on the driven device; and the displaceable element carries at one end a roller engageable by the annular ring, and a pivotal mounting at the opposite end so as to be pivotted in accordance with the axial movement of the annular ring.

It will thus be seen that the carburetor may be set for leaner fuel mixtures under normal driving conditions, and the fuel mixture may be automatically enriched in response to the load so that the richer fuel mixture is supplied to the engine only when needed. Thus, the invention is capable of effecting a significant savings in fuel.

Further features and advantages of the invention will be apparent from the description below.

BRIEF DESCRIPTION OF THE DRAWINGS

The invention is herein described, somewhat diagrammatically and by way of example only, with reference to a preferred embodiment illustrated in the accompanying drawings, wherein.

DESCRIPTION OF THE PREFERRED EMBODIMENT

Figures 1, 2:
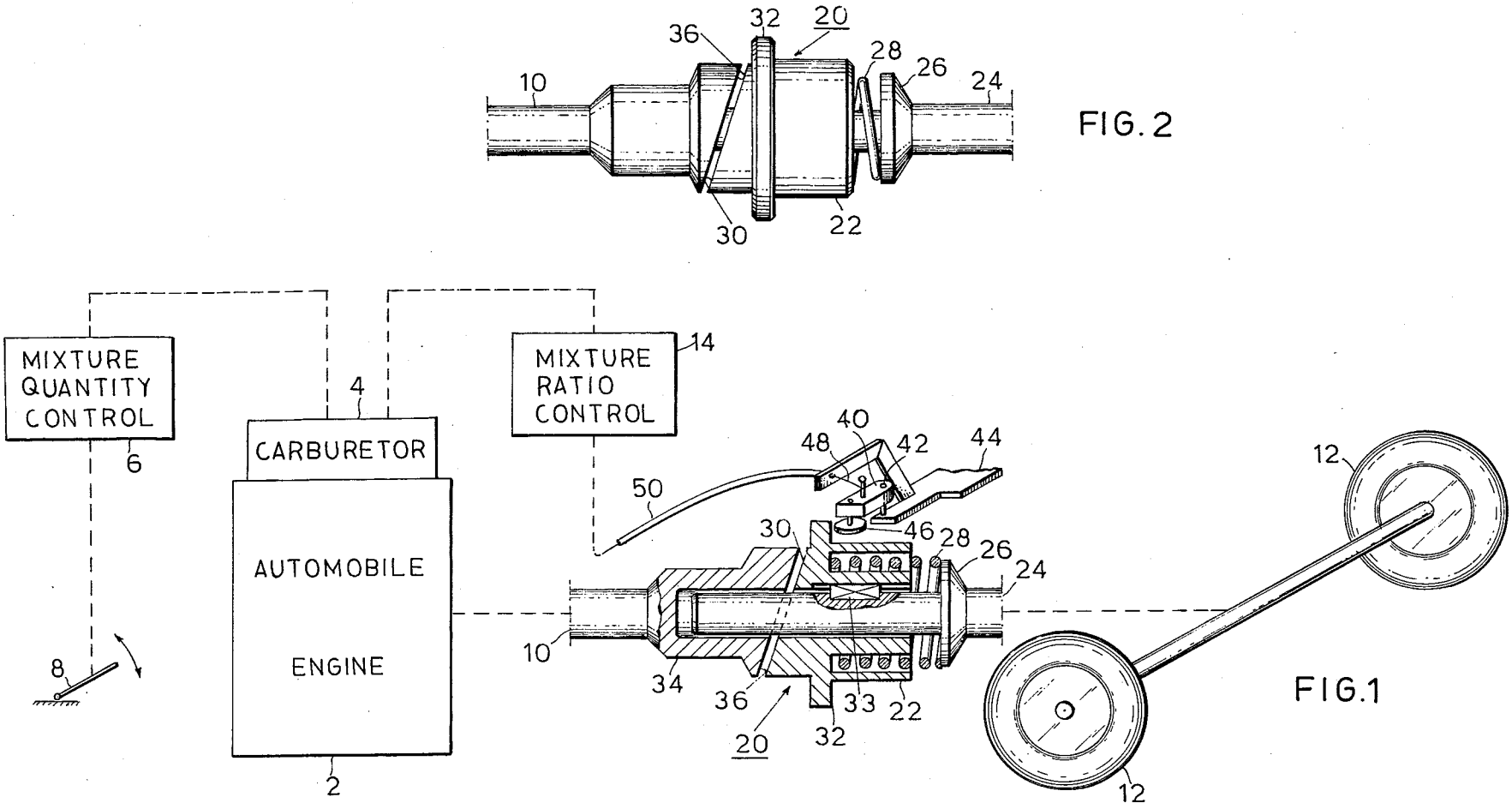
FIG. 1 is a diagram of a system for supplying fuel to an automobile engine, this system including a load-sensor shown in longitudinal section.
FIG. 2 is a side elevational view of the load-sensor in the system of FIG. 1.

The fuel supply system illustrated in FIG. 1 of the drawings diagrammatically shows the automobile engine, generally designated 4. The quantity of the fuel-air mixture supplied by the carburetor to the engine is controlled by a mixture quantity control device, shown by block 6, in accordance with the amount of depression of the automobile accelerator pedal 8. Thus, as more power or motor revoluations-per-minute (RPM) is demanded from the engine, to be supplied via its drive shaft 10 to the automobile wheels 12, accelerator pedal 8 would be more depressed to increase the quantity of the fuel mixture supplied by the carburetor to the engine.

According to the invention, the carburetor 4 includes a mixture-ratio control unit, generally designated 14, which controls the ratio of air and fuel in the mixture supplied to the automobile engine in response to the load applied by the driven wheels 12 on the engine. For example, the mixture-ratio control unit 14 would be set so as to provide a leaner fuel-ratio mixture under normal driving conditions in order to obtain a lower fuel-consumption rate, but as the load on the engine increases, e.g., during rapid acceleration or steep ascents, this increased load is sensed and is used to automatically enrich the fuel-ratio mixture so as to produce the increased power required under such conditions.

The load-sensor in the described embodiment of the invention is generally designated 20. It includes a sleeve 22 enclosing the driven shaft 24 connected to the automobile wheels 12. For this purpose, driven shaft 24 is provided with an annular shoulder 26 spaced from the end of the shaft, and a spring 28 is interposed between shoulder 26 and coupling sleeve 22, spring 28 being received within an axial space or recess formed in the coupling sleeve. The opposite end of coupling sleeve 22 is formed with a cam surface as shown at 30. In addition, the coupling sleeve 22 is also formed with an annular flange or ring 32 adjacent to its cam surface end 30. The sleeve is keyed to shaft 24 by means of one or more ribs 33 received within grooves in the shaft to cause the sleeve to rotate with the shaft but to be displaceable axially with respect thereto.

Drive shaft 10, connected to the automobile engine, is formed with a cylindrical socket 34 for receiving the end of the driven shaft 24. The end face of socket 34 is formed with a cam surface 36 engaging cam surface 30 of coupling sleeve 22. Cam surface 36 on drive shaft 10, as well as cam surface 30 on coupling sleeve 22, may be formed by merely cutting their end faces at a bias or angle to their longitudinal axes.

The load-sensor further includes a displaceable element 40, in the form of an arm pivotally mounted at one end 42 to a fixed member 44, and carrying at its opposite end a roller 46 engageable with annular ring 32 of coupling sleeve 22. A wire 48 is fastened at one end to pivotal arm 40, and passes through a plastic tubing 50 to the mixture-ratio-control unit 14 to control the latter in response to the amount of displacement or pivotting of arm 40.

The mixture-ratio-control device 14, which controls the air-fuel mixture in response to the movement of arm 40 transmitted to it via wire 48, may be any one of many different known types of ratio controls. For example, the device may be one in which the mixture ratio is controlled by enlarging the fuel orifice (e.g., by moving a tapered metering pin) within the carburetor, or one in which a secondary fuel orifice in the carburetor is controlled, or one in which a choke is moved to control the air supply, and thereby the air-fuel mixture ratio. Many such mixture-ratio controls are well known, and therefore it is not deemed necessary to describe them herein in detail.

The control system illustrated in the drawings operates in the following manner:

First, the mixture-ratio-control unit 14 would be set so as to provide a lean air-fuel mixture under normal low-load driving conditions. Under such driving conditions, spring 28 urges coupling sleeve 22 tightly against cam surface 36 of socket 34 carried by drive shaft 10, so that there would be little if any angular displacement or slip between coupling sleeve 22 and the drive shaft 10. Accordingly, there would be no significant axial displacement of the coupling sleeve and its annular ring 32 with respect to roller 46 of pivotal arm 40, and therefore no significant pivotting of the arm, so that wire 48 connected between the arm and mixture-ratio-control device 14 causes the latter to effect a lean mixture.

Now, when the automobile is subjected to increased loads, for example during rapid acceleration or steep ascents, the load on the driven shaft 24 is increased such that there will be a significant angular displacement of slip between cam face 30 of coupling sleeve 32 and cam face 36 of socket 34 on drive shaft 10. This angular displacement, by virtue of cam faces 30 and 36, causes the coupling sleeve to move axially (rightwardly in FIG. 2) according to the degree of the load. In other words, the greater the load, the greater will be the slip, and therefore the greater will be the axial displacement of sleeve 22. This axial displacement of sleeve 22 is transmitted, via annular ring 32 carried by the coupling sleeve 22 and roller 46 carried by pivotal arm 40, to the latter pivotal arm, causing it to pivot and thereby to move wire 48. This movement of the wire is transmitted to the mixture-ratio-control unit 14 to enrich the fuel mixture in order to provide the increased power necessitated by the increase in the load.

It will thus be seen that under normal driving conditions where substantially the same velocity or motor RPM's is to be maintained over a level area, the engine would be operated with a lean air-fuel mixture in order to obtain the maximum mileage per unit of fuel consumed, but as soon as the load is increased, e.g., by rapid acceleration or steep ascent, the automobile automatically would respond to this increased load, as sensed by load-sensor 20, to enrich the fuel in the mixture and thereby to provide an increase in the power output of the engine. The engine is thus capable of lowering the fuel-consumption rate and effecting fuel savings to a significant degree.

While the invention has been described with respect to but one embodiment, it will be obvious that many variations, modifications and other forms of the invention may be made.

What is claimed is:

1. A fuel control system for automobile engines including a carburetor for forming an air-fuel mixture and means for controlling the quantity of said mixture to be supplied to the automobile engine in accordance with the power demanded to be supplied thereby to a member driven by the engine, characterized in that the fuel control system includes load-sensor means for sensing the load applied by the driven member on the engine; and mixture-ratio-control means responsive to said load-sensor means to control the mixture-ratio such as to produce a richer fuel mixture with increased loads and a leaner fuel mixture with decreased loads.

2. A system according to claim 1, wherein said load-sensor comprises: a drive shaft connectable to the engine; a driven shaft connected to the driven member; and a coupling between the two shafts, said coupling including an element displaceable in accordance with the load on the driven shaft, the displacement of said element controlling the mixture-ratio-control means.

3. A system according to claim 2, wherein said coupling includes a coupling member having a cam surface; a spring interposed between said member and the driven shaft and urging the cam surface into engagement with a surface on the drive shaft, said cam surface causing the coupling member to be moved axially with respect to the drive shaft upon changes in load; and means for displacing said displaceable element in accordance with said axial movement of the coupling member.

4. A system according to claim 3, wherein said surface on the drive shaft is also a cam surface.

5. A system according to claim 2, wherein said coupling includes an annular ring which is axially movable in accordance with the load on the driven device; and the displaceable element carries at one end a roller engageable by the annular ring, and a pivotal mounting at the opposite end so as to be pivotted in accordance with the axial movement of the annular ring.

6. A system according to claim 5, wherein said annular ring is formed on a sleeve enclosing the driven shaft; one end of said sleeve being urged against an end of the drive shaft by means of a spring interposed between the sleeve and an annular shoulder fixed to the driven shaft; said one end of the sleeve, and the corresponding end of the drive shaft engaged thereby, being formed with cam surfaces to cause the sleeve to move axially of the driven shaft in response to the load on the driven shaft.

7. A system according to claim 1, wherein the means for controlling the quantity of the mixture supplied to the automobile engine includes a depressible accelerator pedal.

* * * * *